US011688383B2

(12) United States Patent
Gandhi et al.

(10) Patent No.: US 11,688,383 B2
(45) Date of Patent: Jun. 27, 2023

(54) CONTEXT AWARE COMPRESSOR FOR HEADPHONE AUDIO FEEDBACK PATH

(71) Applicant: Apple Inc., Cupertino, CA (US)

(72) Inventors: Navneet Gandhi, Cupertino, CA (US); Daniel S. Phillips, Los Angeles, CA (US); Jarrett B. Lagler, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/460,041

(22) Filed: Aug. 27, 2021

(65) Prior Publication Data

US 2023/0060353 A1 Mar. 2, 2023

(51) Int. Cl.
*G10K 11/178* (2006.01)
*H04R 1/10* (2006.01)

(52) U.S. Cl.
CPC .. *G10K 11/17854* (2018.01); *G10K 11/17821* (2018.01); *G10K 11/17881* (2018.01); *H04R 1/1016* (2013.01); *H04R 1/1083* (2013.01); *G10K 2210/1081* (2013.01); *H04R 2460/01* (2013.01)

(58) Field of Classification Search
CPC ..... G10K 11/17854; G10K 11/17821; G10K 11/17881; G10K 2210/1081; H04R 1/1016; H04R 1/1083; H04R 2460/01
USPC ..... 381/71.1
See application file for complete search history.

(56) References Cited

U.S. PATENT DOCUMENTS 5,359,665 A 10/1994 Werrbach
7,016,509 B1 3/2006 Bharitkar et al.
7,171,010 B2 1/2007 Martin et al.
8,275,152 B2 9/2012 Smirnov et al.
8,693,700 B2 4/2014 Bakalos et al.
9,264,823 B2 2/2016 Bajic et al.
9,515,629 B2 12/2016 Goldstein et al.
9,633,646 B2 4/2017 Hendrix et al.
10,034,092 B1 7/2018 Nawfal et al.
10,074,903 B2 9/2018 Kim et al.
2003/0145025 A1 7/2003 Mired et al.
2004/0032959 A1 2/2004 Montag et al.
(Continued)

FOREIGN PATENT DOCUMENTS

EP 2239725 10/2010
WO WO-9639744 A1 * 12/1996 ..... H03G 7/002

OTHER PUBLICATIONS

Notice of Allowance for U.S. Appl. No. 17/023,314 dated Feb. 11, 2022, 8 pages.
(Continued)

*Primary Examiner* — Vivian C Chin
*Assistant Examiner* — Friedrich Fahnert
(74) *Attorney, Agent, or Firm* — Aikin & Gallant, LLP

(57) ABSTRACT

A processor is configured to perform headphone playback with a playback audio signal. The processor produces a feedback signal from an internal microphone, compresses the feedback signal according to a variable compressor setting, and determines a context of usage of the headphone, as being one of running or jogging, transportation, and critical listening. In response, the processor changes the variable compressor setting and drives the headphone speaker with the compressed feedback signal combined with the playback audio signal. Other aspects are also described and claimed.

16 Claims, 6 Drawing Sheets

(56) References Cited

U.S. PATENT DOCUMENTS

| | | | | |
|---|---|---|---|---|
| 2008/0175409 | A1 | 7/2008 | Lee et al. | |
| 2008/0236369 | A1* | 10/2008 | Sasaki | G10H 1/40 84/612 |
| 2010/0195815 | A1 | 8/2010 | Tada | |
| 2010/0266134 | A1 | 10/2010 | Wertz et al. | |
| 2011/0007907 | A1 | 1/2011 | Park et al. | |
| 2011/0142247 | A1 | 6/2011 | Fellers et al. | |
| 2011/0243344 | A1* | 10/2011 | Bakalos | G10K 11/17837 381/71.1 |
| 2013/0259250 | A1 | 10/2013 | Nicholson et al. | |
| 2014/0093090 | A1 | 4/2014 | Bajic et al. | |
| 2014/0126734 | A1* | 5/2014 | Gauger, Jr | G10K 11/17853 381/71.6 |
| 2014/0341388 | A1 | 11/2014 | Goldstein et al. | |
| 2015/0264469 | A1 | 9/2015 | Murata et al. | |
| 2016/0300562 | A1 | 10/2016 | Goldstein | |
| 2017/0017462 | A1* | 1/2017 | Kubiak | A61B 5/02055 |
| 2017/0125006 | A1 | 5/2017 | Dzhigan et al. | |
| 2017/0133000 | A1* | 5/2017 | Hendrix | G10K 11/17817 |
| 2018/0047383 | A1 | 2/2018 | Hera et al. | |
| 2019/0130930 | A1 | 5/2019 | Tong et al. | |
| 2020/0098347 | A1 | 3/2020 | Kubota et al. | |
| 2020/0374617 | A1 | 11/2020 | Liu et al. | |
| 2021/0097970 | A1 | 4/2021 | Saux et al. | |
| 2021/0099799 | A1 | 4/2021 | Saux et al. | |
| 2021/0185427 | A1* | 6/2021 | Tong | G10K 11/17881 |

OTHER PUBLICATIONS

Unpublished U.S. Appl. No. 17/023,314, filed Sep. 16, 2020.
Unpublished U.S. Appl. No. 17/023,340, filed Sep. 16, 2020.
"Bose QuietComfort Earbuds", Retrieved from the Internet <https://www.bose.com/en_us/products/headphones/earbuds/quietcomfort-earbuds.html#v=qc_earbuds_black, Sep. 10, 2020, 15 pages.
Bristow-Johnson, Robert, "Cookbook formulae for audio equalizer biquad filter coefficients", Retrieved from the Internet <https://www.w3.org/2011/audio/audio-eq-cookbook.html>, May 29, 2020, 7 pages.
Non-Final Office Action for U.S. Appl. No. 17/023,314 dated Sep. 16, 2021, 26 pages.
Non-Final Office Action for U.S. Appl. No. 17/019,774 dated Oct. 22, 2021, 8 pages.

* cited by examiner

CONTEXT AWARE COMPRESSOR FOR HEADPHONE AUDIO FEEDBACK PATH

FIELD

An aspect of the disclosure here relates to digital audio signal processing techniques for improving quality of headphone playback during feedback-type acoustic noise cancellation. Other aspects are also described.

BACKGROUND

Headphones let their users listen to music and participate in phone calls without disturbing others who are nearby. They are used in both loud and quiet ambient environments. Headphones can have various amounts of passive sound isolation against ambient noise. There may be in-ear rubber tips, on-ear cushions, or around-the-ear cushions, or the sound isolation may be simply due to the fact that the headphone housing rests against the ear and therefore loosely blocks the entrance to the ear canal. An electronic technique known as acoustic noise cancellation, ANC, is used to further reduce the ambient environment noise that has leaked past the passive isolation. ANC drives a headphone speaker to produce an anti-noise sound wave that is electronically designed to cancel the ambient noise that gets past the passive isolation and into the user's ear canal. But the performance of ANC varies greatly, depending on how the headphone is fitting to (or how the headphone is being worn) against the wearers ear.

SUMMARY

In headphone technology, there is the so-called S-path which is an audio signal path from the input of a headphone speaker to an output of an internal microphone. Due to the unique structure of the ear, the S-path is different for every wearer, and affects how each wearer hears the same playback audio and how ANC performs (despite the same mechanical and acoustical headphone design.) In a headphone with feedback type ANC, there is an audio signal feedback path from the internal microphone (also referred to sometimes as the error microphone) to the input of the headphone speaker. There is an electronic filter in this feedback path that applies a frequency-dependent gain (sometimes referred to as equalization), that is designed to electronically correct for the differences between the ears of different users. In this manner, the playback sound and ANC are more heard consistently (despite the different ears of the users.) The equalization filter may be designed in the laboratory to conform with what an expert listener specifies as being good sound (by the particular headphone design.)

It has been determined however that if the headphone fits the ear of its wearer too loosely or improperly, due to for instance being bumped out of position slightly, an ear cup being raised slightly off ear briefly, or when the wearer puts on a pair of eye glasses, or when the user's hairs prevent the headphone from making contact with the user's skin, the aforementioned filter has to apply a large gain to compensate for the acoustic energy leaking out of the user's ear in order to maintain the desired timbral characteristics of music as heard by the user. Under certain circumstances such as high playback volumes, where the audio signal is already testing the limits of the acoustic/electrical system, the large gain applied by the fit correcting filter can drive the amplifier, speaker or the acoustic system as a whole beyond its physical limits, e.g., the amplifier that is driving the headphone speaker becomes overloaded, resulting in the playback being distorted.

An aspect of the disclosure here is a method for headphone audio signal processing in which, during playback, an audio feedback signal from an internal microphone of the headphone is filtered, to produce a filtered feedback signal. The filtering may be designed to equalize how the playback should sound despite different users wearing the same headphone design, so that the playback sound is consistently good for the different users' ears. The filtered feedback signal is then compressed. Thus, the speaker of the headphone is being driven with a combined signal in which the compressed feedback signal has been combined with the playback audio signal. One or more of the compressor parameters are then changed, based on one or more context inference signals that includes a user volume setting. In this manner, when the user volume is high, e.g., at maximum, the likelihood of clipping by the headphone amplifier (that is driving the speaker with the combined signal) is reduced, or even eliminated, resulting in undistorted playback. In one aspect, based on system design and tuning, there may be two or more sets of compressor parameters, and an algorithm chooses from these available sets of compressor parameters and interpolates based on one or more of the context inference signals, using linear interpolation or other interpolation scheme, to produce the final set of compressor parameters that are applied to compress the filtered feedback signal.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

Figure 1:
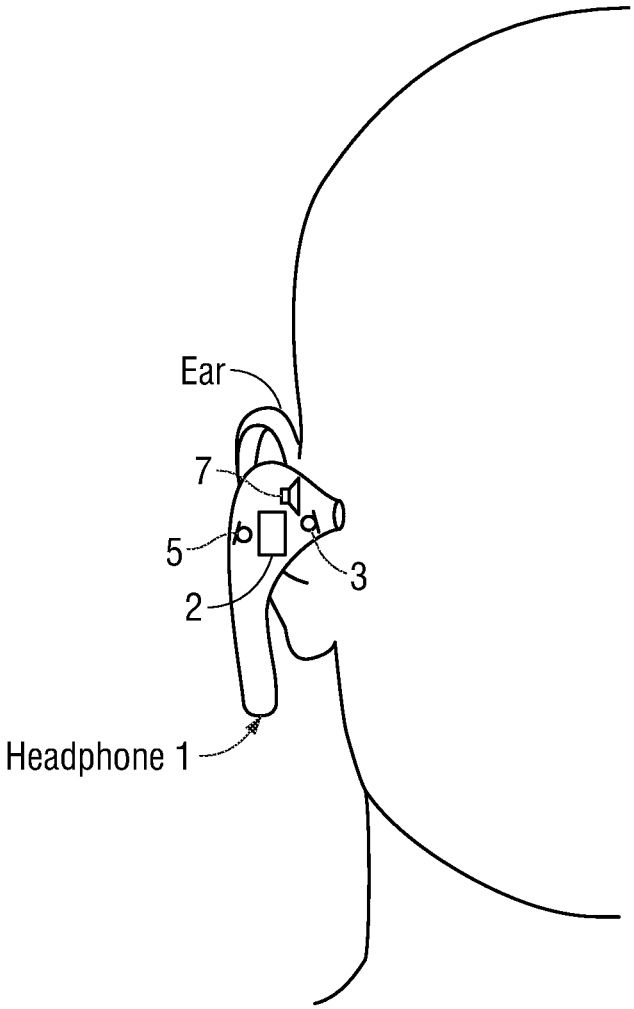
FIG. 1 shows an example headphone with a feedback equalization filter arrangement that can exhibit clipping at high user volume.

FIG. 1 shows an example of a headphone 1 being worn by its user (wearer) in which the systems and methods for digital audio signal processing described below can be implemented. The headphone 1 may be any one of various fit types, such as an over-ear that partially rests directly against the head and surrounds the ear, an on-ear that rests directly against the ear, or an in-ear as shown (an in-ear earbud.) The headphone 1 may have a foam or cushion or other flexible material that further isolates the ear canal from the ambient environment sounds. The headphone 1 may be one of two headphones (left and right) that make up a headset. The methods described below can be implemented in one or both of the headphones that make up a headset.

The headphone 1 has an against-the-ear acoustic transducer or speaker 7 arranged and configured to reproduce sound (that is represented in an audio signal that is said to drive the speaker) into the ear of the user, an external microphone 5 (arranged and configured to receive ambient environment sound directly), and an internal microphone 3 (arranged and configured to directly receive the sound reproduced by the speaker 7.) The headphone 1 is configured to acoustically couple the external microphone to the ambient environment of the headphone, in contrast to the internal microphone being acoustically coupled to a volume of air within the ear that is being blocked by the headphone. As integrated in the headphone 1 and worn by its user, the external microphone 5 may be more sensitive than the internal microphone 3 to a far field sound source outside of the headphone 1. Viewed another way, as integrated in the headphone and worn by its user, the external microphone 5 may be less sensitive than the internal microphone 3 to sound within the user's ear. Here it should be noted that while the figures show a single microphone symbol in each instance (external microphone 5 and internal microphone 3), as producing a sound pickup channel, this does not mean that the sound pickup channel must be produced by only one microphone. In some instances, the sound pickup channel may be the result of combining multiple microphone signals, e.g., by a beamforming process performed on a multichannel output from a microphone array.

In one aspect, along with the transducers and the electronics that process and produce the transducer signals (output microphone signals and an input audio signal to drive the speaker), there is also electronics that is integrated in the headphone housing. Such electronics may include an audio amplifier to drive the speaker with an audio signal (that may include program audio, also referred to here as playback audio), a microphone sensing circuit or amplifier that receives the microphone signals converts them into a desired format for digital signal processing, and a digital processor 2 and associated memory (not shown.) The memory stores instructions for configuring or programing the processor (e.g., instructions to be executed by the processor) to perform digital signal processing methods as described below in detail. A playback audio signal (program audio) that may contain user content such as music, podcast, or the voice of a far end user during a voice communication session, can also be provided to drive the speaker in some modes of operation, e.g., during noise cancellation mode. The playback audio signal may be provided to the processor from an external, audio source device (not shown) such as a smartphone or tablet computer. Alternatively, the playback audio signal could be provided to the processor by a cellular phone network communications interface that is within the housing of the headphone 1.

Figure 2:
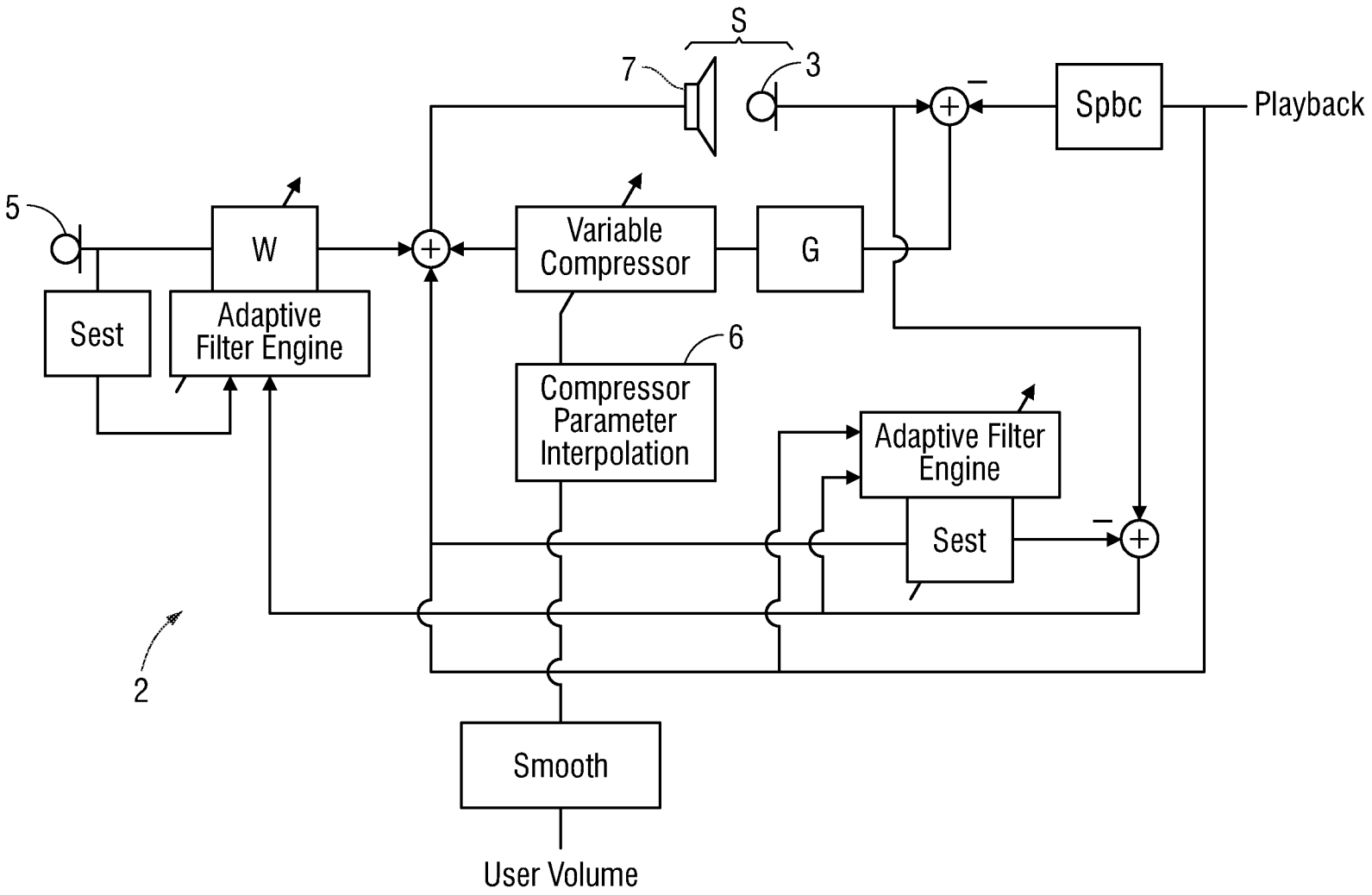
FIG. 2 is a block diagram of an audio signal processing system and method that improves quality of headphone playback using a variable compressor in the feedback path.

Referring now FIG. 2, a block diagram of a system and method for headphone audio signal processing is shown. In headphone technology, there is the S-path which is an audio signal path from the input of the headphone speaker 7 to an output of the internal microphone 3. Due to the unique structure of the ear, the S-path is different for every wearer and affects how each wearer hears the same playback audio and how ANC performs, while wearing a mechanically or acoustically similar headphone design. In the headphone 1, there is feedback type ANC in which there is an audio signal feedback path from the internal microphone 3 (also referred to sometimes as the error microphone in the context of ANC) to the input of the headphone speaker 7. A filter G is added into this feedback path which together with filter Spbc may be referred to here as an arrangement of equalization filters that apply a so-called feedback equalization gain; these filters are designed to electronically correct for the differences between the ears of different users. In this manner, the playback sound and ANC are consistent despite the different ears of the users. The filters G and Spbc may be designed in the laboratory to conform with what an expert listener specifies as being good sound (by the particular headphone design.)

Figure 1A:
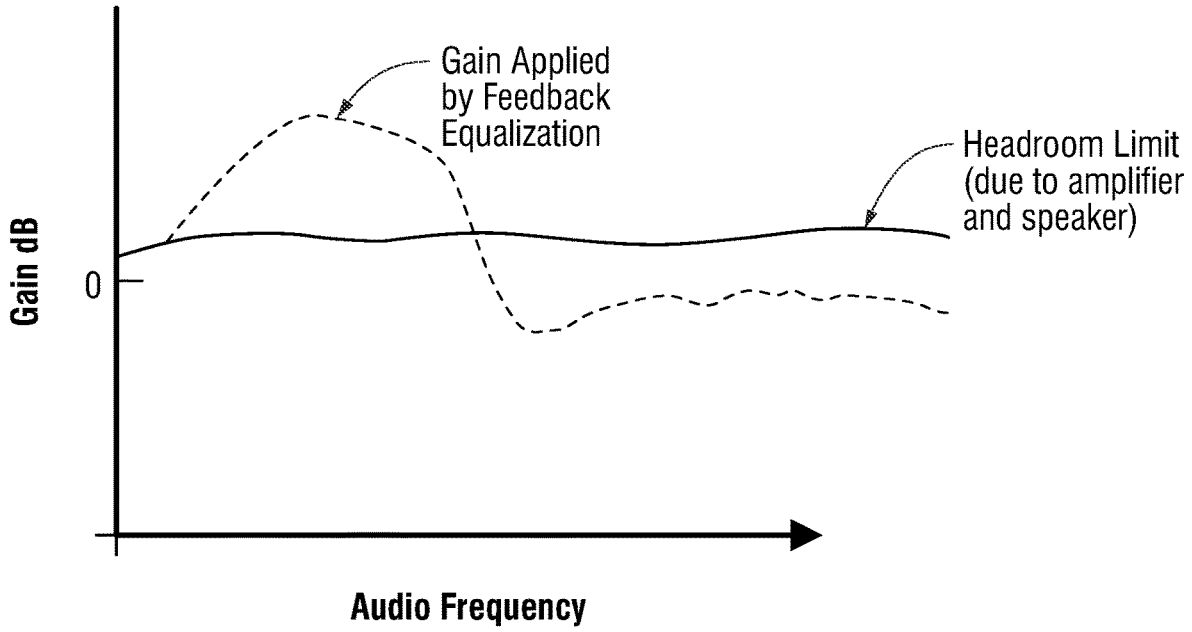
FIG. 1A illustrates an example of how gain has been raised beyond the headroom limit of an acoustic/electrical system in a low frequency region.

It has been determined however that if a particular instance of the headphone 1 fits the ear of its wearer too loosely or improperly due to for instance being bumped out of position slightly or if the wearer puts on a pair of glasses, thereby making the S-path leaky or less sealed (in the acoustic sense), then under certain conditions, such as high user volume, the amplifier (not shown) that is driving the headphone speaker 7 becomes overloaded by the feedback path, resulting in the playback being distorted. This effect is illustrated by a graph in FIG. 1A. In this figure, the headroom limit is defined as the maximum gain that can be applied to a full scale audio signal without clipping downstream, on either the amplifier or the speaker. It can be seen that in a low frequency range, e.g., between 20 Hz and 200 Hz, there is "clipping" of the amplifier output gain signal because the gain applied by the feedback equalization arrangement exceeds the headroom limit that is defined by downstream components such as the amplifier (including its power supply voltage) and the physical limits of the speaker 7. In other words, the audio signal at the input of the amplifier is so strong that it overdrives or overloads the amplifier or speaker which ultimately impairs the wearer's listening experience.

To mitigate the overloading or overdriving of the headphone amplifier, the following method is performed by the processor 2 (see FIG. 1) during playback, to modify the audio signal that is driving the amplifier (which in turn is driving the headphone speaker 7.) A feedback audio signal from the internal microphone 3 is compared with a reference signal generated from the output of the filter Spbc and in turn negative feedback is applied to the feedback audio signal through the filter G, to produce a correction to the playback output from the speaker. The filtered feedback or correction signal is then compressed, by a variable compressor, according to several compressor parameters to produce a compressed signal. In other words, the compressor changes the dynamic range of the audio signal that it receives at its input and adapts its parameters as needed to match the compression to the available headroom. Depending on one or more context inferences signals which in this aspect includes the current user volume (a user volume setting), one or more of the compressor's parameters are changed. The speaker 7 continues to be driven with the compressed feedback signal combined with the playback audio signal (as represented by the summing junction.)

For downward compression (the magnitude of the full band signal or a sub-band component is reduced), the compressor parameters may include two or more of the following: attack time, release time, threshold, compression ratio, and cutoff frequencies (for narrow band compressor blocks.) For instance, when changing the compressor parameters (or the compressor setting), a first compression ratio is selected when the user volume setting is above a threshold, and a second compression ratio is selected when the user volume setting is below the threshold, wherein the first compression ratio is greater than the second compression ratio. For example, a first compressor setting is selected when user volume is maximum, and a second compressor setting is selected when the user volume is below a threshold that is less than the maximum. The first compressor setting can be said to be more aggressive than the second compressor setting. As a result, the headroom limit of the amplifier is not violated.

The variable compressor may be implemented as a digital, low frequency shelf filter, as a direct form, parametric biquad with atomic coefficient update capability. The cut frequency, Q, and gain of such a parametric biquad are variable and are set according to the compression parameters provided by a compressor parameter interpolation block (compressor parameter interpolation 6.) The digital filter however is not limited to being a direct form biquad. The variable compressor may also include a variable broadband gain stage following the low frequency shelf filter. The gain of that stage may be reduced by the compressor parameter interpolation 6 algorithm in situations where for example the expected or predicted output of the low frequency shelf filter is still too strong (or in other words too likely to induce clipping of the headphone amplifier.)

Still referring to FIG. 2, this figure illustrates the particular case where the feedback audio signal is produced by removing, from a signal produced by the internal microphone 3, a Spbc filtered version of the playback audio signal. The Spbc filter, known as a playback correction filter, may be a fixed or slow changing digital filter (not adaptive or fast changing) whose transfer function has been determined in the laboratory to compensate for ear variation across different wearers. The Spbc filter represents a statistically relevant estimate (a central tendency or average across a given population of wearers) of the S-path transfer function tuned in the laboratory for a "good" user, i.e. a user that has fitted the headphones properly to their ear such the acoustic leak if any is assumed to be low; it thus cannot compensate for situations where the headphone 1 is out of position and its acoustic leak is high or severe. High acoustic leak situations occur when for instance the user slightly lifts an ear cup of the headphone 1 off their ear or dons a pair of glasses.

The feedback audio signal is then filtered by the filter G, which is designed to in effect produce a feedback anti-noise signal that is intended to acoustically cancel certain undesired sounds in the S-path. In addition to the feedback anti-noise signal, the case in FIG. 2 produces a feedforward anti-noise signal, by filtering a signal produced by the external microphone 5 using a filter W. Thus, the speaker 7 is driven with the feedforward anti-noise signal combined with the compressed version of the feedback signal and with the playback audio signal (at the output of the summing junction shown in FIG. 2.) Here it should be noted that the feedback anti-noise signal might be produced by a fixed or slow changing digital filter (filter G), while the feedforward anti-noise signal is produced by an adaptive or fast changing digital filter (filter W.) The filter W is adaptive or fast changing because it is being adapted by an ANC adaptive filter engine (e.g., a least means squares, LMS, engine), using an adaptive estimate of the transfer function of S-path, namely Sest. The Sest transfer function is also being adapted, by another adaptive filter engine (e.g., another LMS engine) is being performed by the adaptive filter engine as shown.

The combination of the feedforward and feedback anti-noise signals as described above work well to create a quiet hearing experience for the wearer (during playback for example), so long as the headphone 1 is being worn "properly" in that the acoustic leakage is not severe or poor. But severe leakage or poor acoustic seal could occur while the user volume is above a certain threshold, e.g., at maximum. Note here that the removal of the Spbc-filtered version of the playback is far from perfect under those acoustic leakage conditions, such that there is residual playback audio into the filter G. For instance, if the headphone fit or seal is poor so that acoustic leakage is high, then the error microphone signal contains very little of the S-path version of the playback audio, while the Spbc version of the playback audio is being subtracted from the error microphone signal. This residual playback is then undesirably subjected to a high feedback path gain of the filter G. The variable compressor in the feedback path suppresses peaks of this undesirable version of the (residual) playback. Also, by changing the setting of the variable compressor to be more aggressive only in certain contexts, and particularly in response to the being above a certain threshold, the risk of the filtered feedback signal overdriving the headphone amplifier in case the headphone 1 is bumped out of position or its ear cup is briefly lifted off the ear, in reduced or even eliminated. At the same time, the variable compressor will be automatically re-configured into a less aggressive setting in other contexts (including one where the user volume is below the threshold), so that dynamic range of the sound produced by the headphone speaker 7 remains high (thereby maintaining improved user experience.)

Continuing with the description of FIG. 2, note that in many scenarios, the ANC mode of operation is performed during user content media playback (playback), where a program audio signal containing for example music or a podcast or the voice of a far end user in a phone call is being combined into the single audio signal that is driving the speaker 7. In other cases, the program audio signal (playback) is silent during noise cancellation mode. That case is handled by the processor being configured to detect when user volume is below a threshold or that the playback has stopped, and in response change the variable compressor setting by decreasing the compression ratio (or making the compressor settings less aggressive.)

Figure 6:
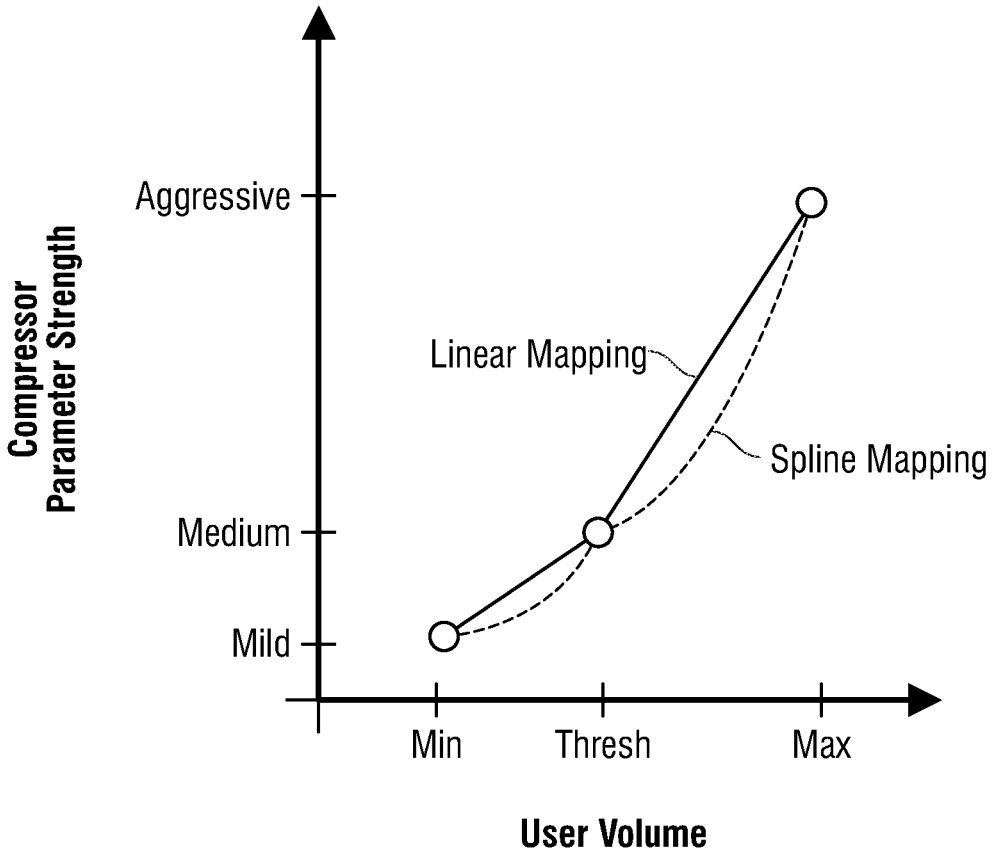
FIG. 6 depicts an example of compressor parameter interpolation versus user volume setting.

FIG. 2 also depicts another aspect of the disclosure here, namely that of changing the compressor parameters using interpolation, so that only a relatively small number of compressor settings need to be determined in the laboratory and stored in the headphone 1. The compressor parameters are tuned based on recordings made in various scenarios in which the headphone 1 is expected to be used, e.g., while riding in a bus or an airplane, at low and high user volume settings. The filtered feedback signal is compressed according to a set of interpolated compressor parameters, in response to the user volume setting changing between the low user volume setting and the high user volume setting. A compressor parameter interpolation block (compressor parameter interpolation 6) interpolates between i) a stored, first set of compressor parameters that are for use at a low user volume setting and a stored, second set of compressor parameters that are for use at a high user volume setting, to produce the set of interpolated compressor parameters. FIG. 6 depicts an example of compressor parameter interpolation versus user volume setting in which the solid line indicates linear interpolation between a low (minimum), threshold, and high (maximum) user volume, resulting in mild, medium and aggressive compressor parameters strengths, respectively. The interpolation may be extended to the several different compressor parameters. Note also that interpolation strategies other than linear interpolation are acceptable depending on system needs, e.g., higher order interpolation such as spline interpolation.

Another aspect of the disclosure here, which is also illustrated in FIG. 2, is that the processor can be configured to smooth the user volume even when the user volume is changing by only a single click. Thus, the variable compressor setting is interpolated based on the smoothed user volume (rather than based on the user volume setting directly), which avoids glitch and transition artifacts in the playback output from the speaker.

Figure 3:
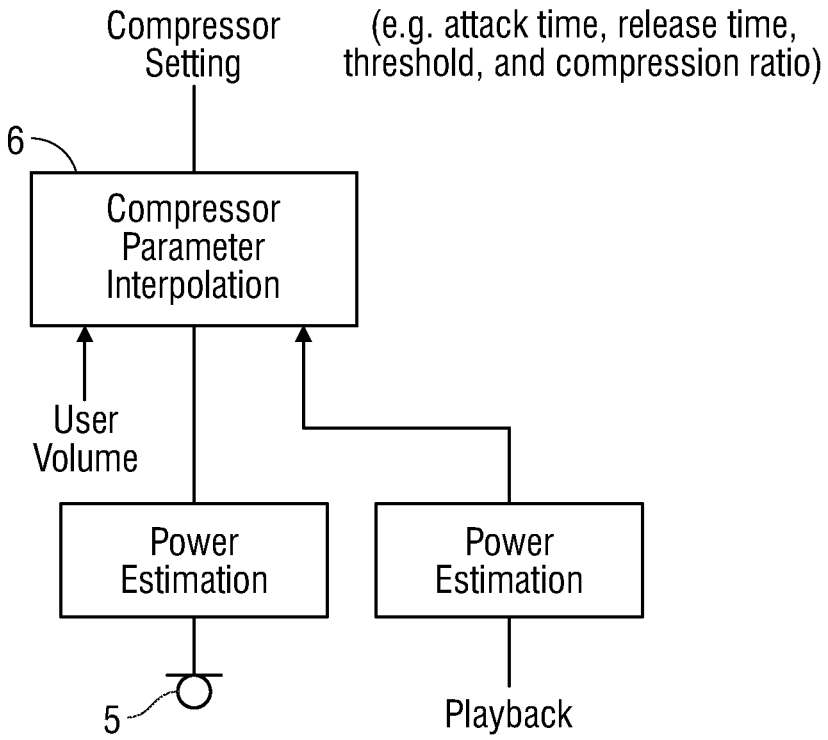
FIG. 3 illustrates the aspect where a variable compressor setting changes according to estimates of the strength of ambient environment sound or the playback content.

Turning to FIG. 3, this figure illustrates an aspect of the disclosure in which the variable compressor setting changes according to estimates of the strength of the ambient environment sound or the playback content. The strengths may be computed as power estimations of a microphone audio signal from the external microphone 5, and the playback audio signal. These power estimations may for example be root mean square, RMS, level computations of the audio signals. The compressor parameter interpolation 6 algorithm changes the compressor setting to a more aggressive one when either of those two power estimates is above their respective thresholds (expected to produce headphone amplifier clipping events.) In another aspect, the compressor setting can be stepped gradually to become more aggressive as the power estimate increases and eventually passes the clipping threshold.

Figure 4:
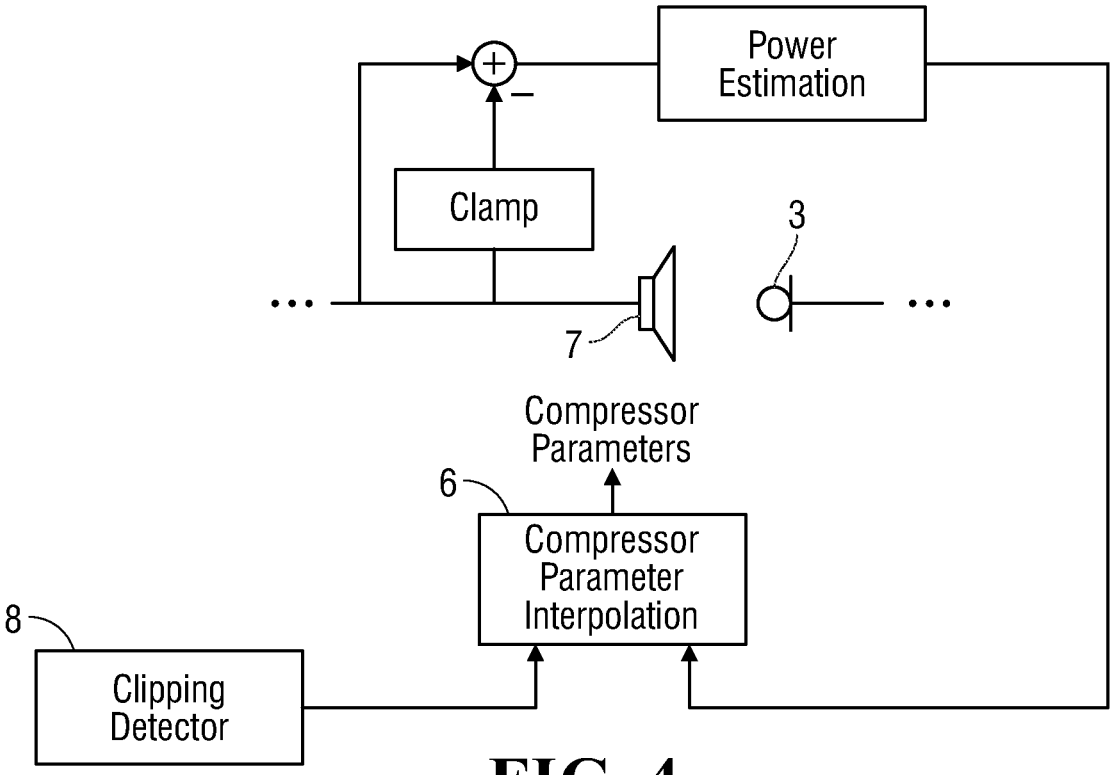
FIG. 4 depicts an aspect in which a clipping detector informs the compressor parameter interpolation logic.

In yet another aspect, illustrated in FIG. 4, rather than computing power estimates, any other type of metric (linear or nonlinear) may be computed by a clipping detector 8, using for example the external microphone audio signal or the playback audio signal, e.g., the number of clipping events per second, such that the compressor parameters are changed (in accordance with a more aggressive setting) when the number of clipping events per second are higher than a threshold. In a further aspect, a hangover countdown timer may be set upon changing to a more aggressive setting, such that a less aggressive setting is not resumed until the timer has expired (regardless of the number of clipping events per second dropping or the power estimate dropping.)

Figure 5:
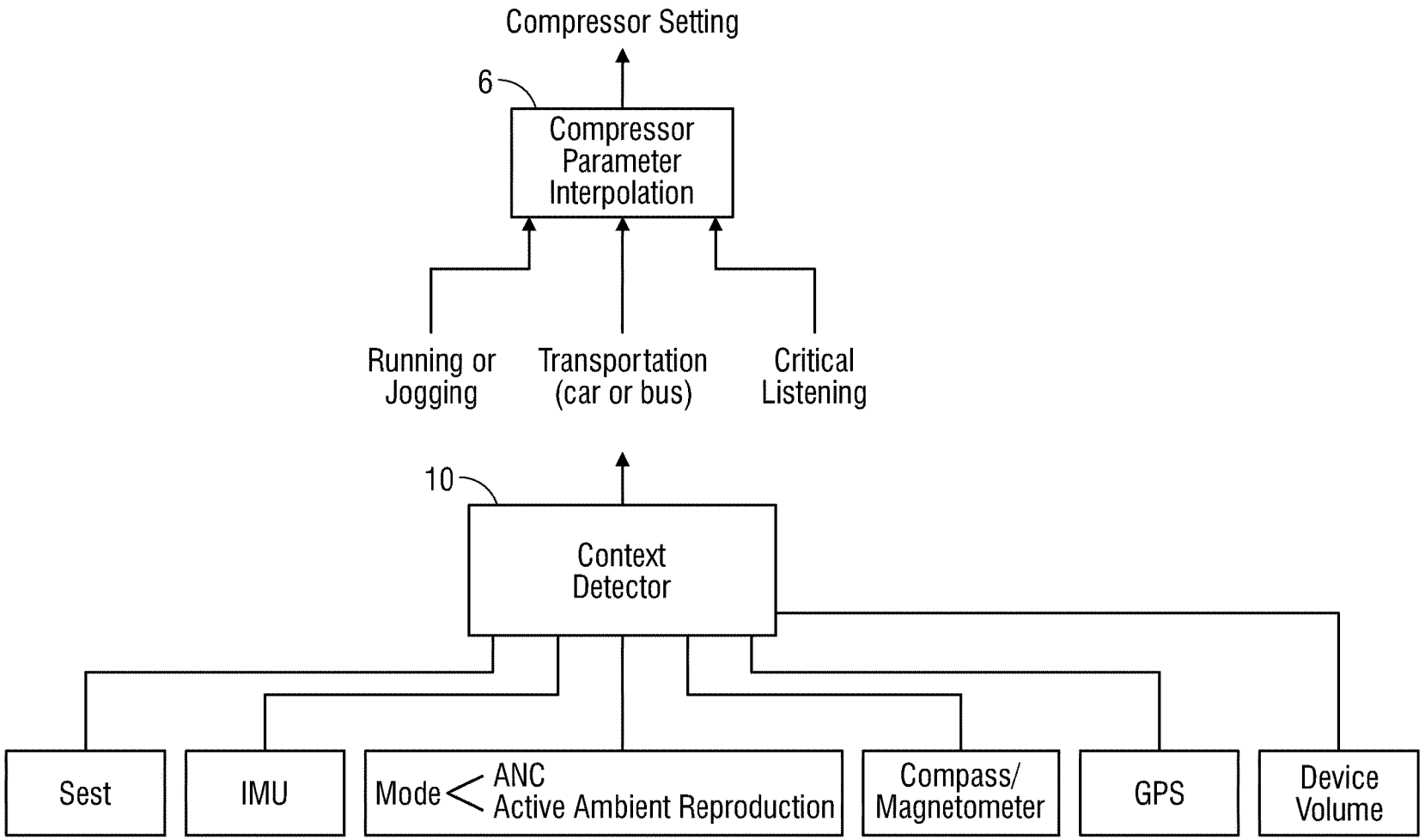
FIG. 5 shows the aspect where the variable compressor setting changes as a function of usage contexts of the headphone other than user volume.

The aspects of the disclosure described above refer to a variable compressor (in the feedback anti-noise signal path from the internal microphone) that is controlled according to either user volume, ambient environment sound level, playback content level, or clipping events derived from audio signals such as the external microphone audio signal or the playback audio signal. FIG. 5 shows another aspect of the disclosure here in which the variable compressor setting changes as a function of usage contexts of the headphone (usage contexts other than user volume.) The processor is now configured determine a context of usage of the headphone 1, as being one of running or jogging, transportation (e.g., car or bus), and critical listening, and in response change the variable compressor setting. This action by the processor is represented in FIG. 5 by a context detector block (content detector 10.)

The wearer walking or jogging could be determined by the processor (context detector 10) receiving an indication from a companion device that is paired or otherwise communicatively coupled to the headphone 1 (e.g., a smartphone, a tablet computer, a laptop computer, or a smartwatch), or it could be determined by processing an inertial measurement unit, IMU, output signal.

Critical listening refers to situations where sound is reproduced with high fidelity and without the non-linear effects that compression introduces. Such a wearer is typically sitting or lying down in a quiet ambient environment like a studio (not riding in a bus or a car, not inside a restaurant); the processor (context detector 10) may determine the context of usage as being critical listening by receiving an indication from the companion, or by processing an inertial measurement unit output signal to determine that the companion device or the headphone 1 is motionless.

Riding in car or a bus or an airplane may be determined by the processor receiving an indication from the companion device, or by processing a global positioning system location signal, a compass/magnetometer signal, or a communication network connection.

In another aspect of the disclosure here, the context detector 10 can signal the compressor parameter estimation 6 that it has detected a user context as being severe acoustic leak at the headphone 1, based on having processed (as a context inference signal) the Sest estimate of the S-path transfer function. Yet another user context that may be detected by the context detector 10 is whether ANC mode is active or whether ambient sound reproduction mode is active. In response to each of these detected user contexts, the compressor parameter interpolation 6 would change the compressor setting to better suit the particular user context.

In another aspect of the disclosure here, the processor changes the variable compressor to a more aggressive setting, or activates the variable compressor (by interpolating between a first setting and a second setting) only if the user volume is above a threshold. In other words, the compressor is activated or made more aggressive only if the user volume is above the threshold; if the user volume is below the threshold, then regardless of another user context being detected (by the context detector 10), the compressor setting is not changed (by the compressor parameter interpolation 6.) That may be because the tuning process performed in the laboratory has concluded that a default compressor setting (e.g., no compression) is acceptable for all of the available user contexts.

In yet another aspect, the processor is configured to change the variable compressor setting to its most aggressive setting regardless of the detected context of usage, whenever user volume is set to maximum, e.g., during music playback. In one aspect, the context aware compressor settings may include the following: no compression during critical listening; slow attack and slow release during transportation such as bus or airplane, and fast attack and fast release during maximum user volume with music playback. Note that the terms and slow and fast are relative to each other, meaning that a fast attack time is shorter than a slow attack time, and similarly for the release times.

It is well understood that the use of personally identifiable information should follow privacy policies and practices that are generally recognized as meeting or exceeding industry or governmental requirements for maintaining the privacy of users. In particular, personally identifiable information or data should be managed and handled so as to minimize risks of unintentional or unauthorized access or use, and the nature of authorized use should be clearly indicated to users.

While certain aspects have been described above and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for headphone audio signal processing, the method comprising:

performing playback by driving a speaker of a headphone with a playback audio signal; and during the playback:

filtering an audio feedback signal from an internal microphone of the headphone, to produce a filtered feedback signal;

changing two or more of a plurality of compressor parameters based on one or more context inference signals that includes a user volume setting wherein the plurality of compressor parameters comprise attack time, release time, threshold, and compression ratio;

compressing the filtered feedback signal according to the plurality of compressor parameters to produce a compressed feedback signal; and driving the speaker of the headphone with the compressed feedback signal combined with the playback audio signal.

2. The method of claim 1 further comprising removing, from a signal produced by the internal microphone, a filtered version of the playback audio signal, to produce the audio feedback signal.

3. The method of claim 2 further comprising:

filtering a signal produced by an external microphone of the headphone, to produce a feedforward anti-noise signal; and driving the speaker of the headphone with the feedforward anti-noise signal combined with the compressed feedback signal and with the playback audio signal.

4. The method of claim 3 wherein the filtered feedback signal is produced by a fixed or slow changing digital filter, while the feedforward anti-noise signal is produced by an adaptive or fast changing digital filter that is being adapted based on an adaptive estimate of a transfer function between an input of the speaker and an output of the internal microphone.

5. The method of claim 1 wherein changing the compressor parameters comprises:

interpolating between i) a stored, first set of compressor parameters for use at a low user volume setting and ii) a stored, second set of compressor parameters for use at a high user volume setting, to produce a set of interpolated compressor parameters; and compressing the filtered feedback signal according to the set of interpolated compressor parameters in response to the user volume setting changing between the low user volume setting and the high user volume setting.

6. The method of claim 1 wherein changing the compressor parameters comprises selecting a first compression ratio when the user volume setting is above a threshold, and a second compression ratio when the user volume setting is below the threshold, wherein the first compression ratio is greater than the second compression ratio.

7. The method of claim 1 further comprising:

determining a rate of clipping events, and wherein changing the compressor parameters comprises selecting a higher compression ratio when the rate of clipping events is above a threshold, and a lower compression ratio when the rate of clipping events is below the threshold.

8. The method of claim 1 further comprising determining a strength of the playback audio signal and determining the strength of headphone environment noise, wherein changing the compressor parameters comprises:

selecting a higher compression ratio when either i) a power of the playback audio signal or ii) a power of the headphone environment noise are above their respective thresholds, and a lower compression ratio when the powers of the playback audio signal and the headphone environment noise are below their respective thresholds, the plurality of compressor parameters comprise two or more of:

attack time, release time, threshold, and compression ratio.

9. The method of claim 1 wherein the context inference signals comprise two or more of:

an inertial measurement unit output signal, a global positioning system location signal, an estimate of a transfer function between an input of the speaker and an output of the internal microphone, and a mode of operation of the headphone being acoustic noise cancellation mode or ambient sound reproduction mode.

10. A headphone comprising:

a speaker;

an internal microphone; and a processor configured to perform playback by driving the speaker with a playback audio signal, and during the playback:

produce a feedback signal from the internal microphone, compress the feedback signal according to a variable compressor setting to produce a compressed feedback signal, wherein the variable compressor setting is compression ratio that is at a first setting when user volume is maximum, and a second setting when the user volume is below a threshold that is less than the maximum, and wherein the processor is configured to detect when the user volume is below the threshold or that the playback has stopped and in response decrease the compression ratio; and drive the speaker of the headphone with the compressed feedback signal combined with the playback audio signal.

11. The headphone of claim 10 wherein the processor is configured to interpolate the variable compressor setting between the first setting and the second setting when the user volume is between the threshold and the maximum.

12. The headphone of claim 11 wherein the processor is configured to smooth the user volume even when the user volume is changing by only a single click, and interpolate the variable compressing setting based on the smoothed user volume.

13. The headphone of claim 10 wherein the processor is configured to determine a context of usage of the headphone as being one of running or jogging, transportation, and critical listening, and in response change the variable compressor setting.

14. The headphone of claim 13 wherein the processor changes the variable compressor setting by interpolating between the first setting and the second setting i) when the user volume is between the threshold and the maximum and ii) based on the determined context of usage of the headphone.

15. A processor configured to:

produce a feedback signal from an internal microphone of a headphone, compress the feedback signal according to a variable compressor setting, to produce a compressed feedback signal, determine a context of usage of the headphone, as being one of i) transportation, by receiving an indication from a companion device or by processing a global positioning system location signal or a communication network connection, or ii) critical listening, by receiving an indication from the companion device or by processing an inertial measurement unit output signal, and in response change the variable compressor setting; and drive a speaker of the headphone with the compressed feedback signal combined with a playback audio signal.

16. The processor of claim 15 wherein the processor is configured to change the variable compressor setting to its most aggressive setting regardless of the context of usage of the headphone, when user volume is set to maximum.

* * * * *